US006340291B1

(12) United States Patent
Reckert

(10) Patent No.: US 6,340,291 B1
(45) Date of Patent: Jan. 22, 2002

(54) HIGH PRESSURE IMPELLER WITH HIGH EFFICIENCY FOR SMALL VOLUME FLOWS FOR RADIAL BLOWERS OF DIFFERENT SIZE

(76) Inventor: Lothar Reckert, Oldendorfer St. 13, D-29587 Natendorf (DE)

( * ) Notice: Subject to any disclaimer, the term of this patent is extended or adjusted under 35 U.S.C. 154(b) by 0 days.

(21) Appl. No.: 09/458,314

(22) Filed: Dec. 10, 1999

(30) Foreign Application Priority Data

Dec. 18, 1998 (EP) ..... 98124090

(51) Int. Cl.[7] ..... F04D 29/38
(52) U.S. Cl. ..... 416/185; 416/223 B
(58) Field of Search ..... 416/18 S, 186 R, 416/223 R, 223 B, 182, 183, 175, 203

(56) References Cited

U.S. PATENT DOCUMENTS

| | | | | |
|---|---|---|---|---|
| 2,767,906 A | | 10/1956 | Doyle | 230/134 |
| 3,788,765 A | * | 1/1974 | Rusak | 416/186 R |
| 4,666,373 A | * | 5/1987 | Sugiura | 416/186 R |
| 4,944,654 A | * | 7/1990 | Chou et al. | 415/208.1 |
| 5,741,123 A | * | 4/1998 | Pauly | 416/186 R |
| 5,964,576 A | * | 10/1999 | Fujita et al. | 416/223 B |

FOREIGN PATENT DOCUMENTS

| | | |
|---|---|---|
| DE | 927M821 | 5/1955 |
| DE | 33 29 298 A1 | 2/1985 |
| EP | 0 237 602 | 9/1987 |
| EP | 0 843 101 A2 | 5/1998 |
| FR | 2 713 720 | 6/1995 |
| WO | WO 96/08655 | 3/1996 |

* cited by examiner

*Primary Examiner*—Edward K. Look
*Assistant Examiner*—James M McAleenan
(74) *Attorney, Agent, or Firm*—Roberts & Mercanti, LLP

(57) ABSTRACT

The invention relates to an impeller for radial blowers or fans, comprising a cover, a central bore for fixing to a driving shaft and a plurality of impeller blades passing in part spiral manner from the outside to the bore. Radial blowers with such impellers have an inadequate power or capacity for certain applications. In addition, they cannot be operated independently of the mains and are also overdimensioned. A high pressure impeller for small volume flows with a significantly increased efficiency and incorporated into a miniaturized, mains-independent radial blower would be highly desirable. The latter is obtained in that the cross-section $A_k$ of the impeller blade channel in its last third up to the circumferential edge becomes smaller or remains constant, in that it is given a profile-like configuration corresponding to the impeller blade thickness, the blade entry angle $\beta_1$ having a value >40°.

5 Claims, 9 Drawing Sheets

HIGH PRESSURE IMPELLER WITH HIGH EFFICIENCY FOR SMALL VOLUME FLOWS FOR RADIAL BLOWERS OF DIFFERENT SIZE

BACKGROUND OF THE INVENTION

1. Field of the Invention

The invention relates to an impeller, particularly a high pressure impeller, for radial blowers or fans.

2. Description of the Related Art

In the air pollution control field measuring instruments are used for determining the bacterial content of the air. In the impaction method the air is accelerated in a slot-like cross-section to speeds of 10 to 70 m/sec.

The volume flows are 28 to 100 l/min. The pressure differences required are 200 to 5000 Pa. The necessary blower capacity or power is 1 to 9 Watt.

The filtration method is also used in determining the bacterial content of the air. Air is sucked through filters and the bacteria or germs are deposited on the filter.

The volume flows are 3.5 to 150 l/min and the necessary pressure differences 300 to 800 Pa. The necessary blower capacity is 1 to 20 Watt.

In the work protection field dust meters and protective clothing with filtered respiratory air are used. In this field the blower power or capacity levels are also in the aforementioned range.

In surgery use is made of ventilated respiratory air protective hoods with the aforementioned blower power levels.

For the treatment of sleep-related breathing problems and with respect to life-preserving measures (artificial breathing) equipment is required in the medical sector, which also needs the above blower power levels.

Extensive market research has shown that small blowers with the above-described power requirements are not available. Thus, working takes place in practice with greatly overdimensioned radial blowers (power consumption up to 350 Watt) or also vacuum pumps (power consumption up to 500 Watt). Under these conditions it is not possible to achieve a desired, mains-independent operation (accumulator or battery).

A known radial blower which at least comes close to the requisite power is described hereinafter. The direct current motor used for this blower has the same data as that used in the invention. The sole difference is that it cannot be so highly loaded. Up to a voltage of 13.2 V the delivered power and speed of both motors are the same.

The problem of the invention is to improve the aforementioned impeller in such a way that it has a considerable power increase and can in particular be used as a high pressure impeller for small volume flows with a significant efficiency improvement.

A further object of the invention is, as a result of this power increase, to bring about a miniaturization and a linked weight reduction in the case of radial compressors, so that new fields of application are rendered accessible to them.

SUMMARY OF THE INVENTION

According to the invention this problem is solved by the impeller characterized in claim 1. Tests have surprisingly revealed that the blade entry or contact angle pl should be min. 40° and max. 80°.

BRIEF DESCRIPTION OF THE DRAWINGS

Measurements took place with the impeller (FIGS. 1 and 2) according to claims 1 and 2 in the casing with a guide spiral.

Figure 1:
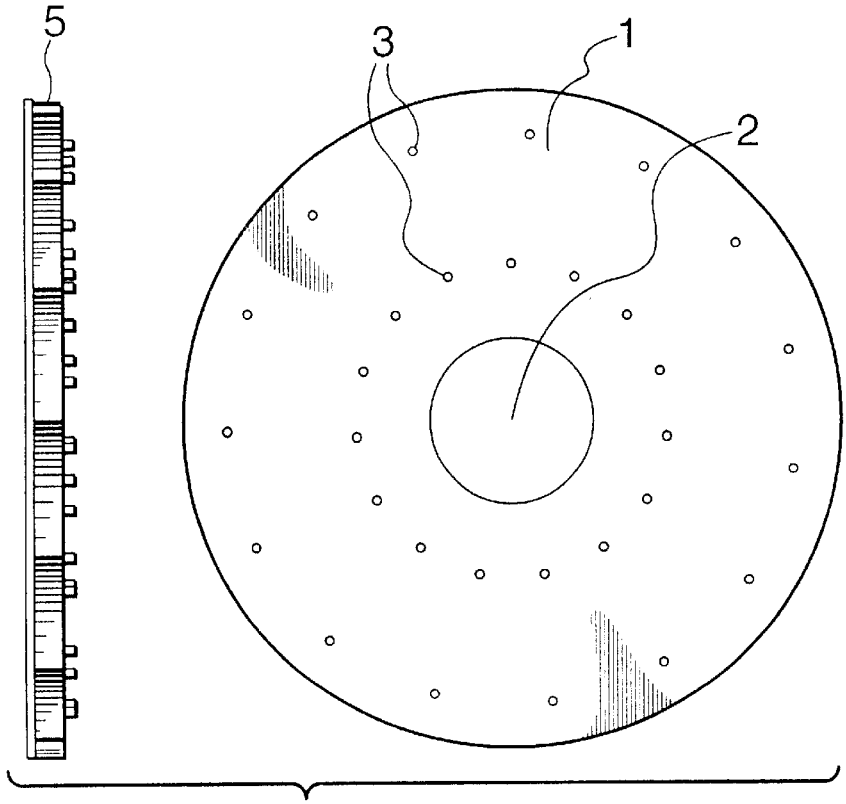

Drive motor: rated voltage 9 V, idling speed 10,000 r.p.m., type capacity 20 Watt, torque constant 7.97 mNm/Amp and max. efficiency 77.1%.

FIGS. 4, 5, 6, 7 and 8 show the pressure difference as a function of the volume flow, the motor power consumption and the efficiency of the overall system of the radial compressor according the present invention.

Figure 4:
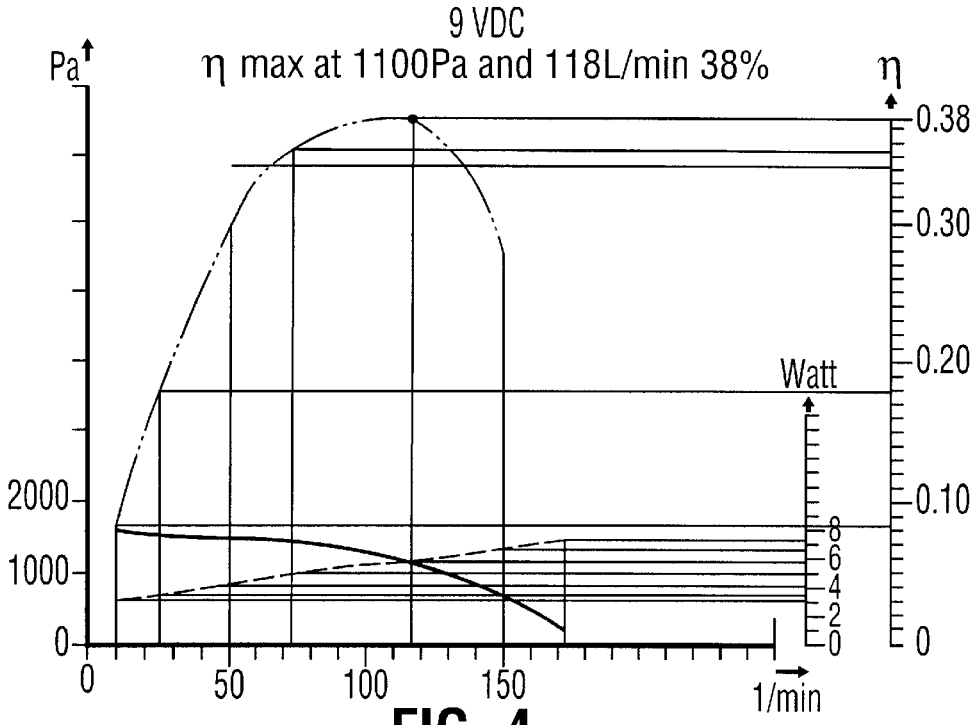

In the graph of FIG. 4 are given the pressure difference as a function of the volume flow (line of equal enthalpy), the motor power consumption and the efficiency of the overall system (blower power/motor input).

The efficiency of the radial compressor was determined from the calculated values of the motor delivery power (with the parameters of the operating point of the maximum efficiency of the complete system) (blower power/motor delivery capacity).

First measurement at a constant voltage of 9 V.

Maximum efficiency of the overall system 38% at 1100 Pa and 118 l/min. Blower efficiency 54% at 1100 Pa and 118 /min.

Figure 5:
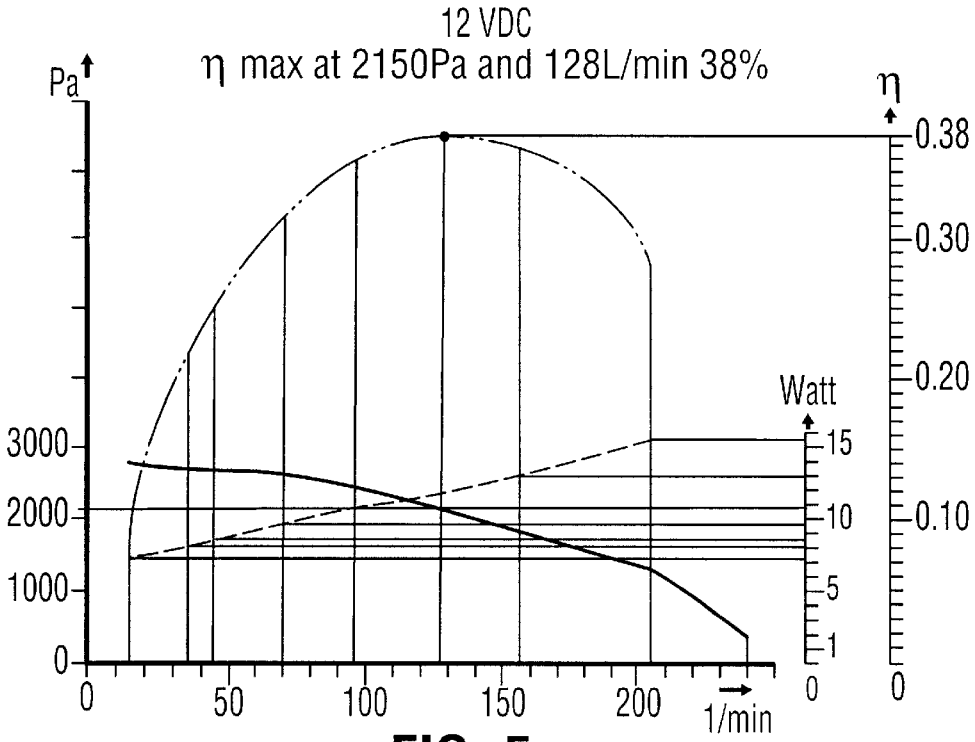

Second measurement at a constant voltage of 12 V (radial blower, as above) cf. graph of FIG. 5.

Maximum efficiency of the overall system 38% at 2150 Pa and 128 l/min. Blower efficiency 53% at 2150 Pa and 128 l/min.

Figure 6:
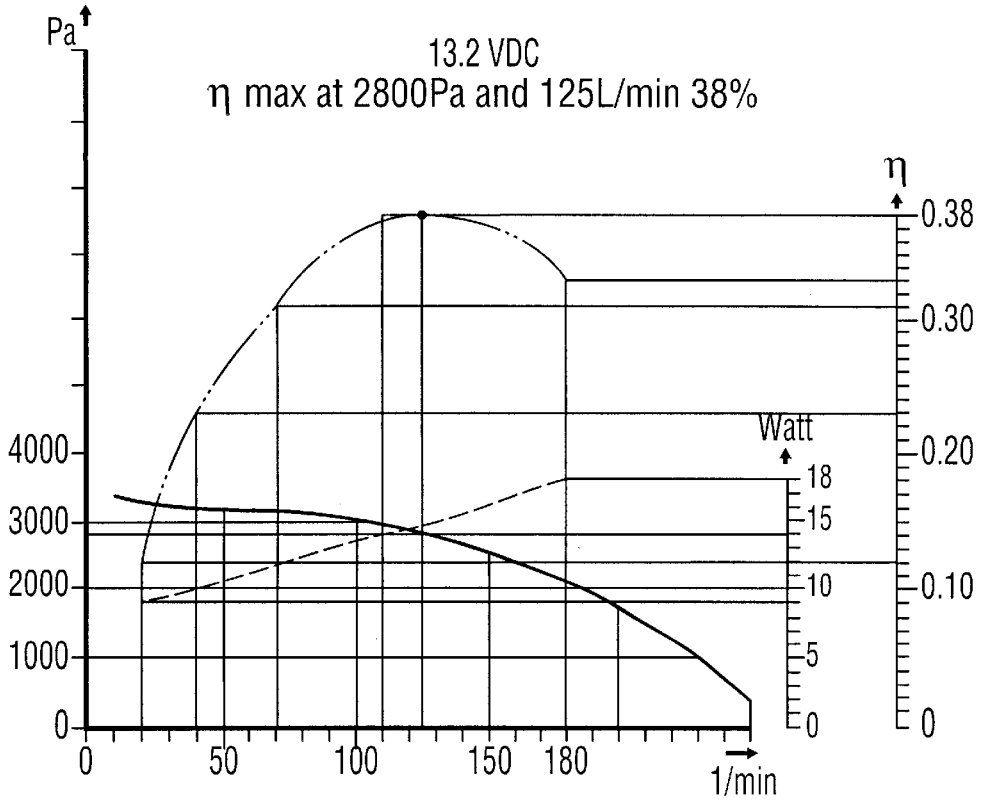

Third measurement at a constant voltage of 13.2 V (radial blower, as above), cf. graph of FIG. 6.

Maximum efficiency of the overall system 38% at 2800 Pa and 125 l/min. Blower efficiency 52% at 2800 Pa and 125 l/min.

Figure 7:
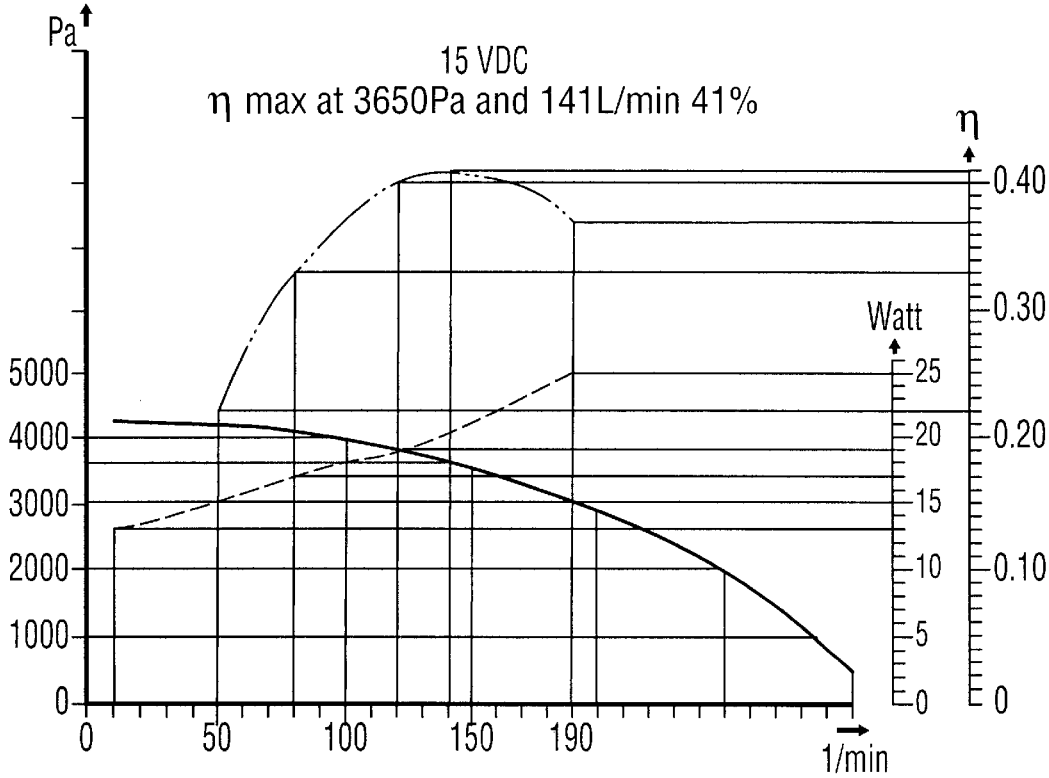

Fourth measurement at a constant voltage of 15 V (radial blower, as above), cf. graph of FIG. 7.

Figure 9:
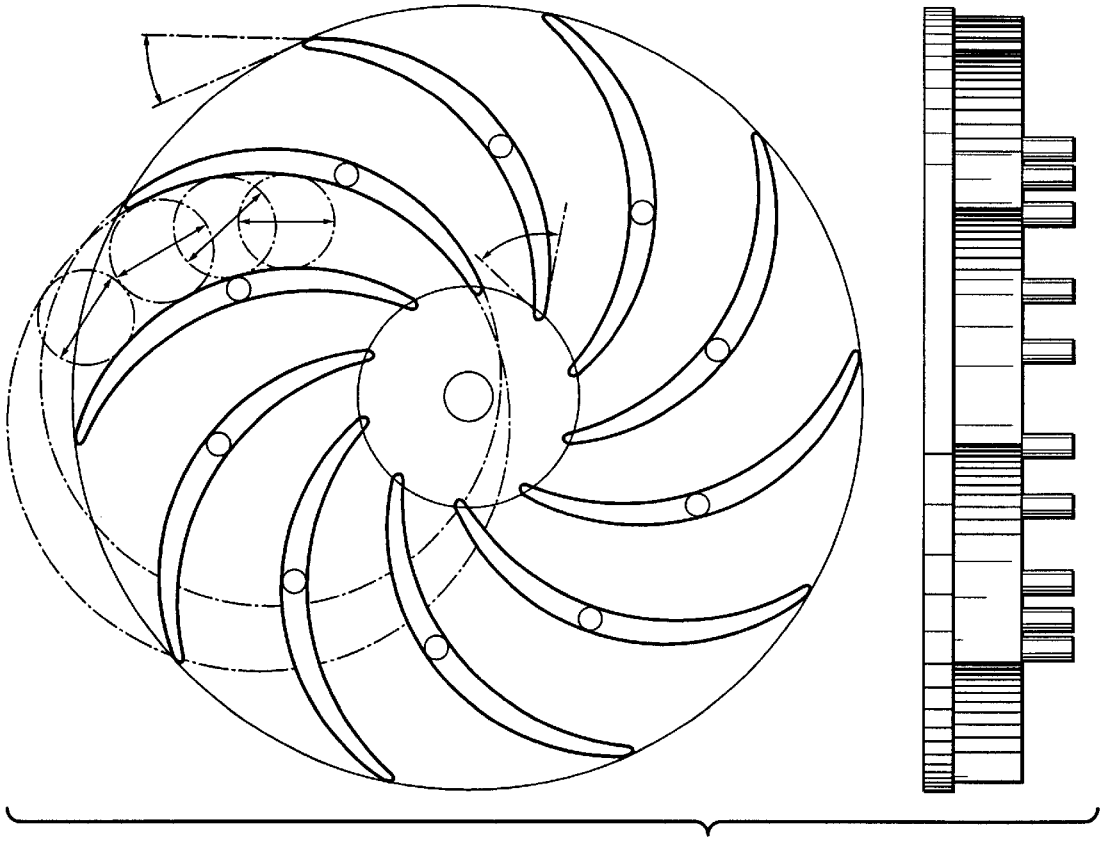

FIG. 9 show the impeller having a diameter of 26 mm according to the present invention.

Figure 10:
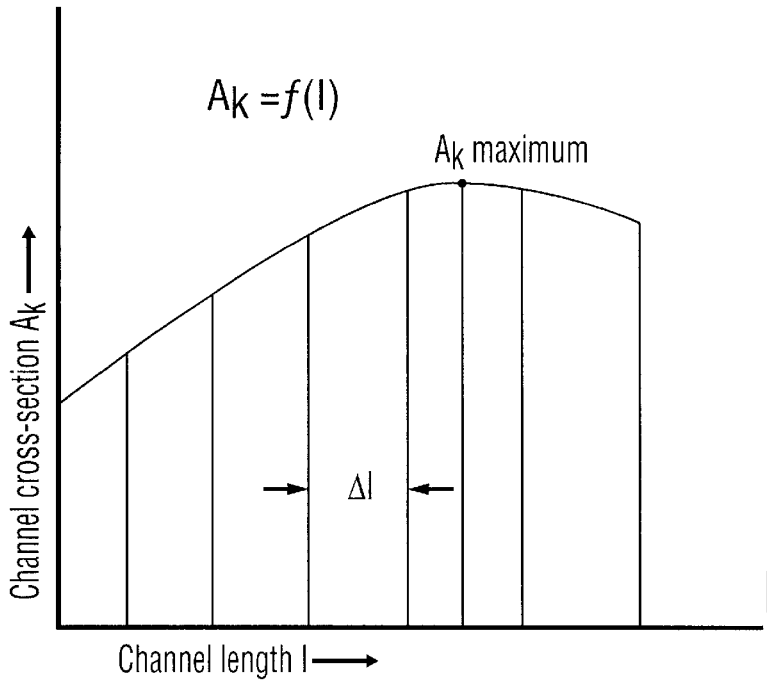

FIG. 10 show the blade channel cross-section $A_k$ as a function of the channel length L according to the present invention.

Maximum efficiency of the overall system 41% at 3650 Pa and 141 l/min. Blower efficiency 55.7% at 3650 Pa and 141 l/min.

Figure 8:
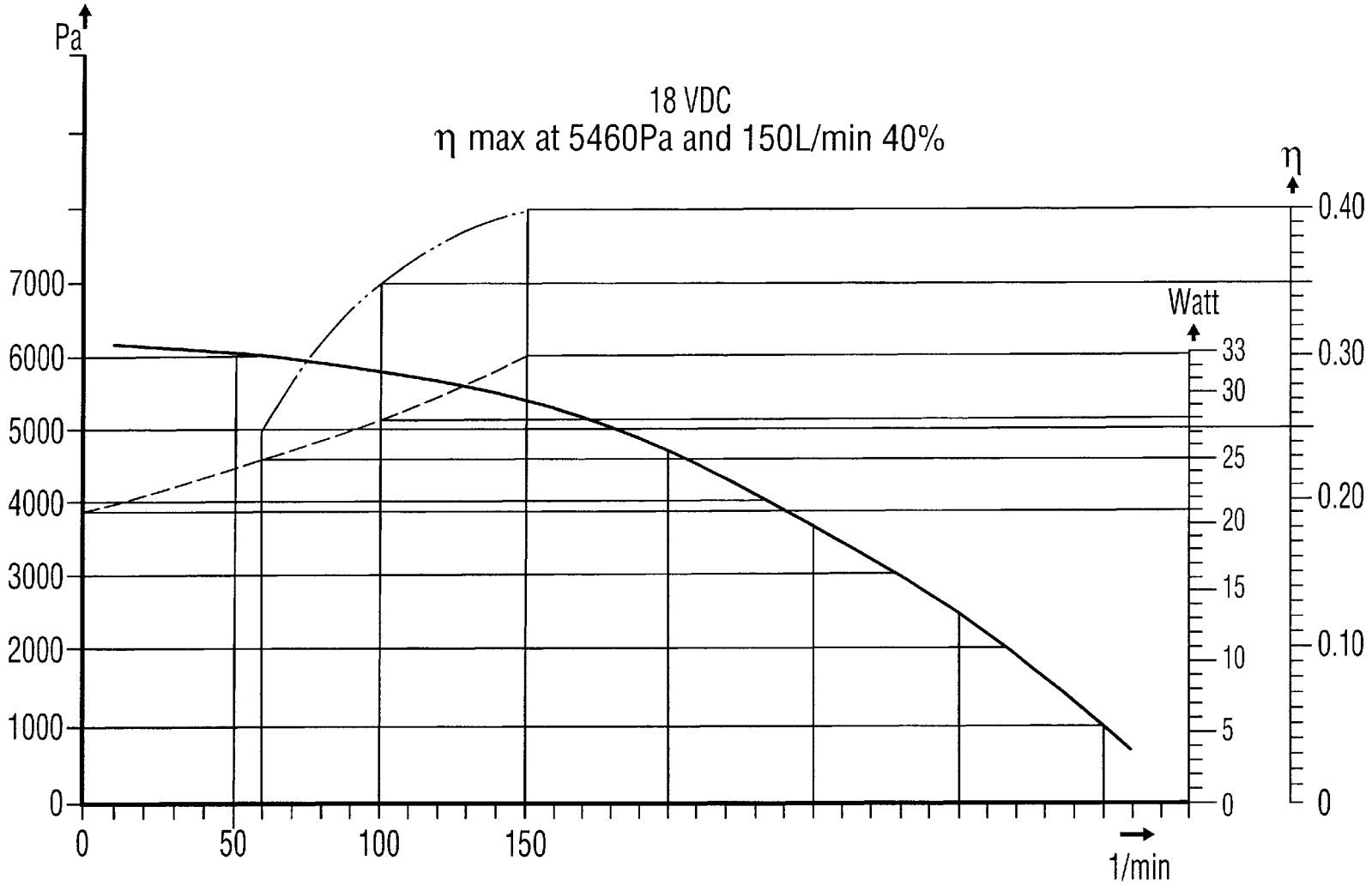

Fifth measurement at a constant voltage of 18 V (radial blower, as above), cf. graph of FIG. 8.

DETAILED DESCRIPTION OF THE PREFERRED EMBODIMENT

Maximum efficiency of the overall system 40% at 5460 Pa and 150 l/min. Blower efficiency 50.5% at 5460 Pa and 150 l/min.

Figure 3:
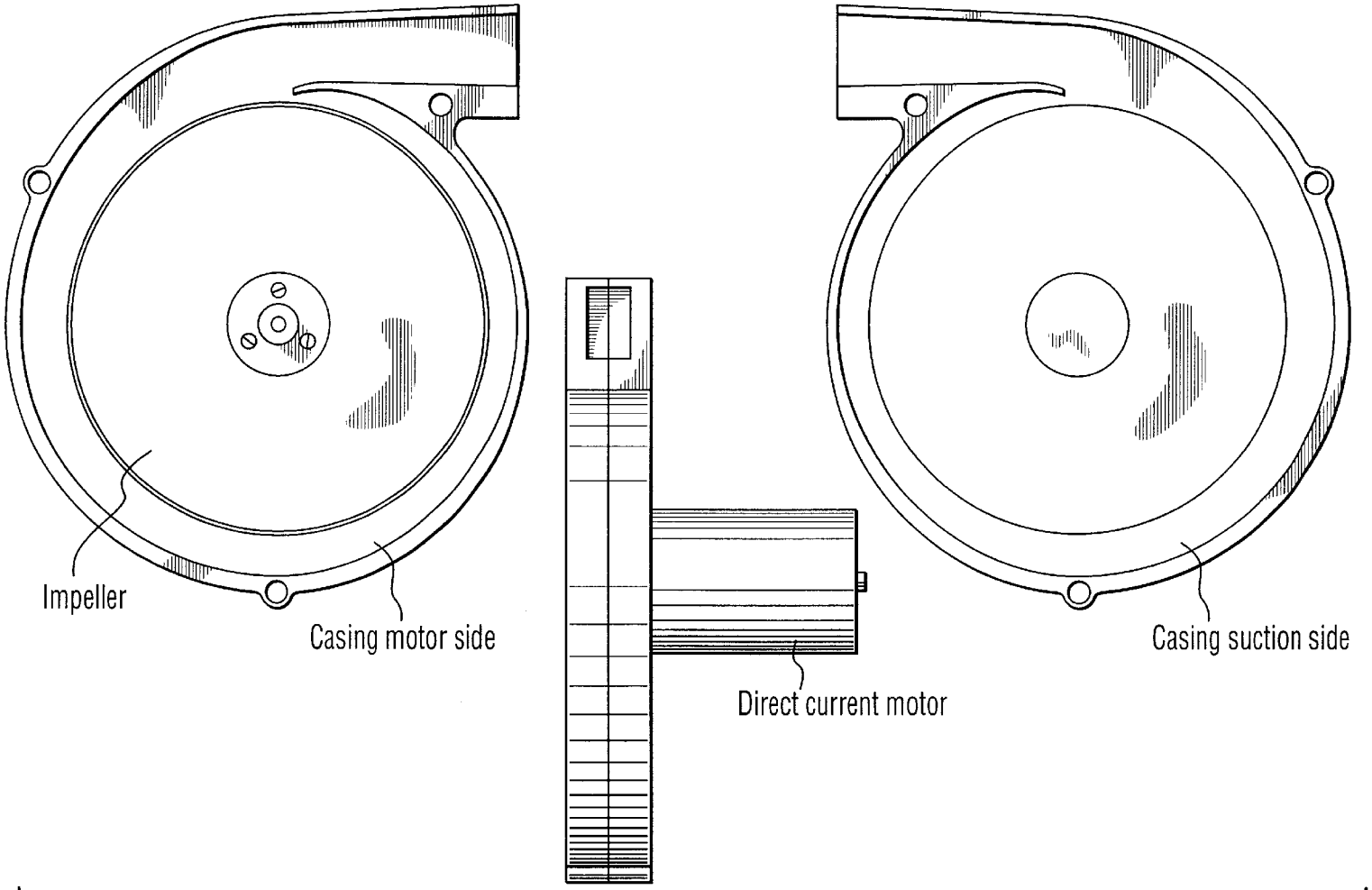
FIG. 3 shows the complete radial blower of the claimed invention.

In particular as a result of the special impeller construction according to claims 1 and 2, with a blade entry angle $\beta_1$=70.7° (so that the entry opening of the blade channel is directed towards the impeller centre) and a blade channel of the form shown in FIG. 3, a very high efficiency was obtained in a surprising and unforeseeable manner.

In all five measured operating ranges the blower efficiency is between 50.5 and 55.7%.

A comparison with the prior art radial blower U97EM-12KK-3 12VDC of Micronel AG with the measurements according to the invention at 12 and 13.2 V reveals in the range 50 to 100 l/min a three times higher blower power according to the invention for the same motor voltage.

Tests with blade entry angles $\beta_1<40°$ (the values calculated according to "Pfleiderer, C: Die Kreiselpumpen für Flüssigkeiten und Gase, Springer-Verlag, Berlin, Göttingen, Heidelberg, 1961, pp 1–23, 91–248 and 352–393" for the five measured operating ranges of the blade entry angle were between 36 and 37°) gave a 50% reduction of the pumping capacity. The impellers were operated with angles smaller than 40° in the same casing.

Tests with a blade channel cross-section which continuously increased up to the end of the circumferential edge (as in Bohl, Willi: Strömungs-maschinen, Vogel (Vogel-Fachbuch) (Kamprath-Reihe), 2nd calculation and design—5th edition, 1995) also led to a deterioration of the blower capacity.

Tests revealed that the impeller designed according to claim 1 and/or 2 is the main reason for the considerable power increase whilst simultaneously increasing the efficiency.

The high efficiency is all the more surprising, because the aforementioned literature states the contrary. The most important magnitudes and quantities given are the specific speed $n_q$ and blower size, expressed in volume flow. For radial impellers the specific speed $n_q$ should be between 10 and 80 $min^{-1}$.

In the five tests with the impeller designed according to the invention the $n_q$ values were 9.1 to 9.9 $min^{-1}$ and consequently do not even reach the lower limit.

The volume flow in the blower is so small that it is not even represented in the literature mentioned (FIG. 1.31 on p 35). It is assumed that a blower with such a size has such a poor efficiency that it is no longer relevant. However, the inventor has found that this is not the case.

Since here a small blower with good efficiency is desired, it was merely necessary to increase the specific speed. A doubling of the motor speed would increase the $n_q$ value to 20 $min^{-1}$, which enables the reverse conclusion to be drawn that the blower impeller design according to the invention leads to the fact that with even relatively low speeds, compared with the impeller diameter, good results can be obtained.

Consideration of the static pressure (volume flow=0) or, measured at the suction side, also known as suction force.

DE 3204113 A1 gives for normal domestic vacuum cleaners per mm of head of water suction force a 0.26 to 0.29 Watt power consumption, i.e. on average 0.275 Watt.

The invention described in the above specification requires on average per mm head of water 0.17 Watt, which means a power increase of almost 40% compared with normal domestic vacuum cleaners.

The above invention relates to a three-stage blower (three rotors and two stators). Domestic vacuum cleaners also generally have a multistage blower.

In the case of the five measurements or tests performed with the impeller according to the invention per mm head of water suction force 0.0225 to 0.034 Watt were required, i.e. on average 0.0287 Watt.

This gives a power increased compared with domestic vacuum cleaners of 89% and compared with the invention of the above specification 83%.

The much higher efficiency of the novel miniature blower (approx. 40%) compared with domestic vacuum cleaners (according to the manufacturer 12 to 22%) indicates that with the impeller (larger diameter) according to claim 1 and/or 2 it is possible to also improve blowers of this size. It is obviously possible with the novel impeller to develop multistage blowers.

Tests with a further size-decreased impeller (FIG. 10) according to claim 1 and/or 2 impeller diameter 26 mm, blade height 2.5 mm, closed impeller.

Impeller drive motor: d.c. motor 0.25 Watt, rated voltage 3.5 V, weight 3.5 g, total weight: impeller, spiral casing, motor: 9.5 g.

The even smaller blower was integrated into a cylindrical casing with a diameter of 40 mm and a length of 100 mm and air was sucked through a diameter 37 mm filter. On said filter were deposited particles, bacteria and fungus spores up to a diameter of 0.3 $\mu$m. The small operational model of a miniature atmospheric bacteria collector was operated by a lithium battery with a rated voltage of 3.6 V. The power consumed by the motor was 0.054 Watt. The operating time with a single battery was 150 hours. The volume flow through the filter was 60 liters per hour. The total weight of the operational model was 90 g.

For the first time long-term measurements could be carried out with this battery-operated miniature atmospheric bacteria collector. Its low weight (90 g) also permitted person-related measurements, because it can be easily carried on the person.

The present invention is explained in further detail hereinafter in exemplified manner relative to FIGS. 1 to 11.

Figure 2:
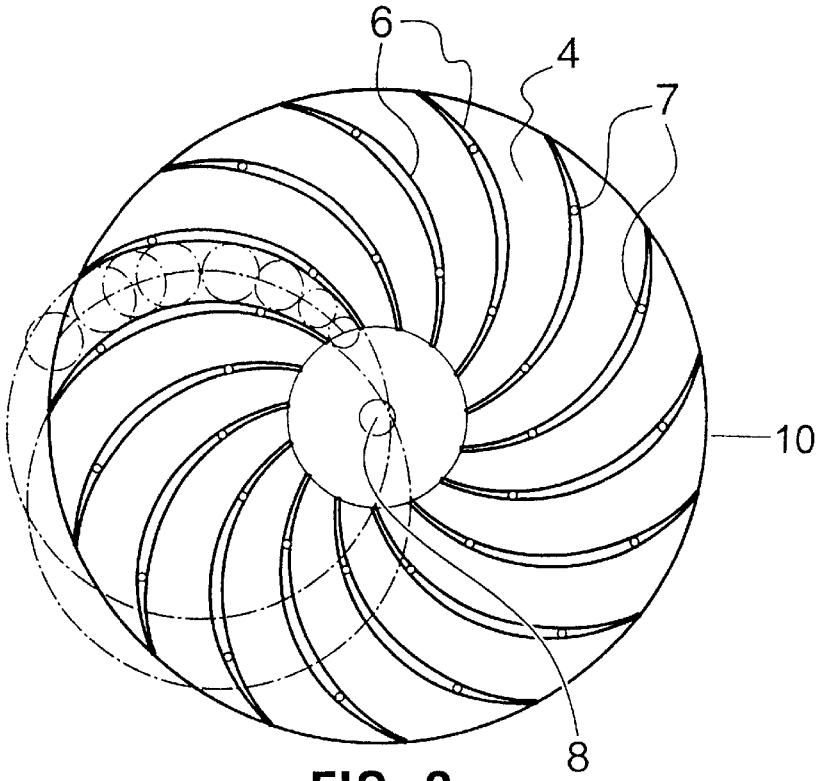

FIGS. 1 and 2 show in plan view the radial impeller according to the invention.

FIG. 1 shows the cover of the impeller, which comprises a flat, circular disk(1), which has in its centre a circular opening (2). The cover has on one or more bolthole circles (as a function of the impeller diameter) bores (3) corresponding to the number of blades.

The impeller (4) shown in FIG. 2 is milled from one piece (or constructed as a plastic injection moulding) and the blade height (5) is constant (see cross-sectional representation). The blades (6) are curved rearwards. Cylindrical studs (7) for receiving the cover (1) are located on the blades (6) on one or more bolthole circles. The studs (7) are ultrasonically welded (in the case of plastic) or riveted (in the case of metal) to the cover (1). The central bore (8) is used for fixing to the driving shaft.

Figure 2A:
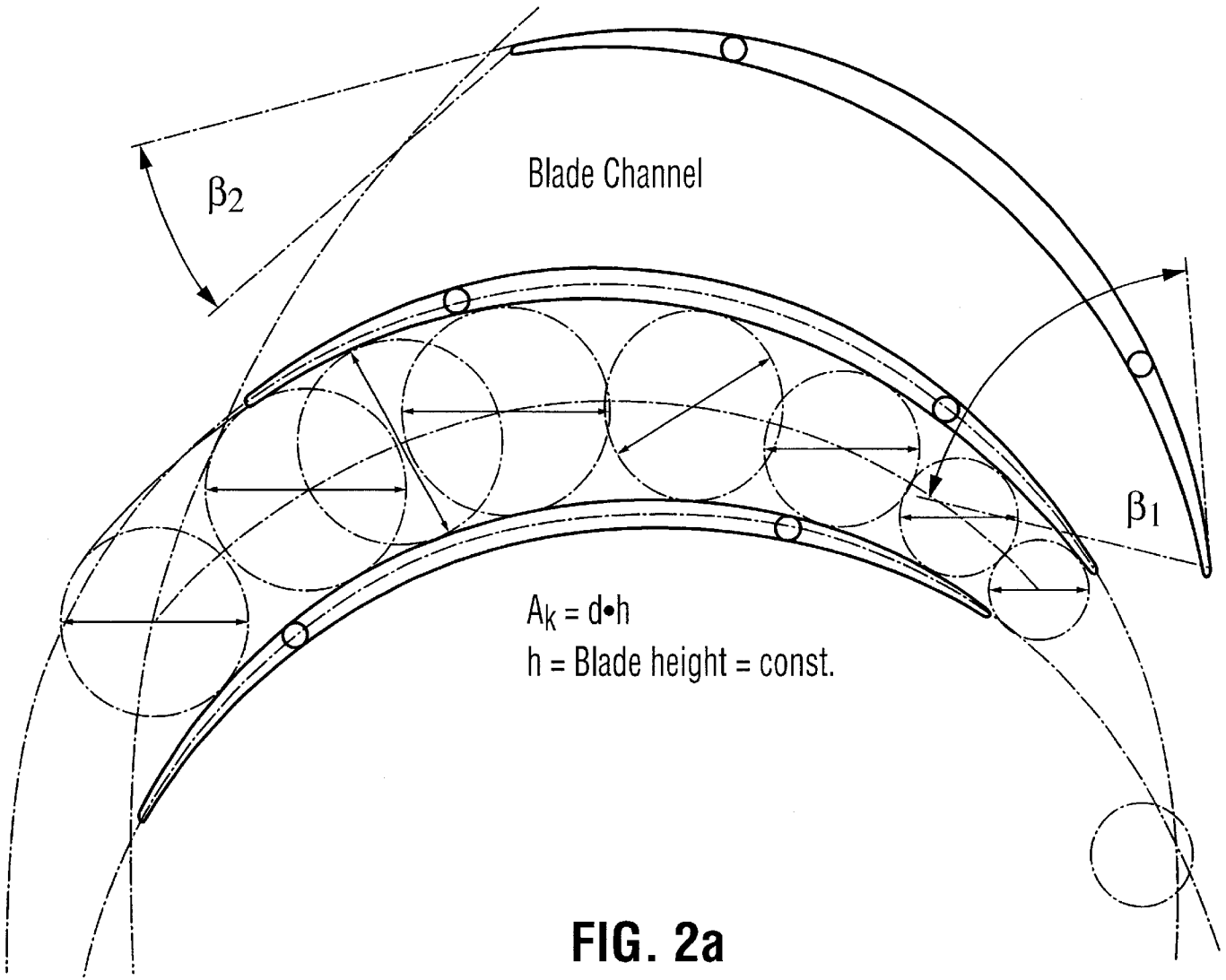
Figure 2B:
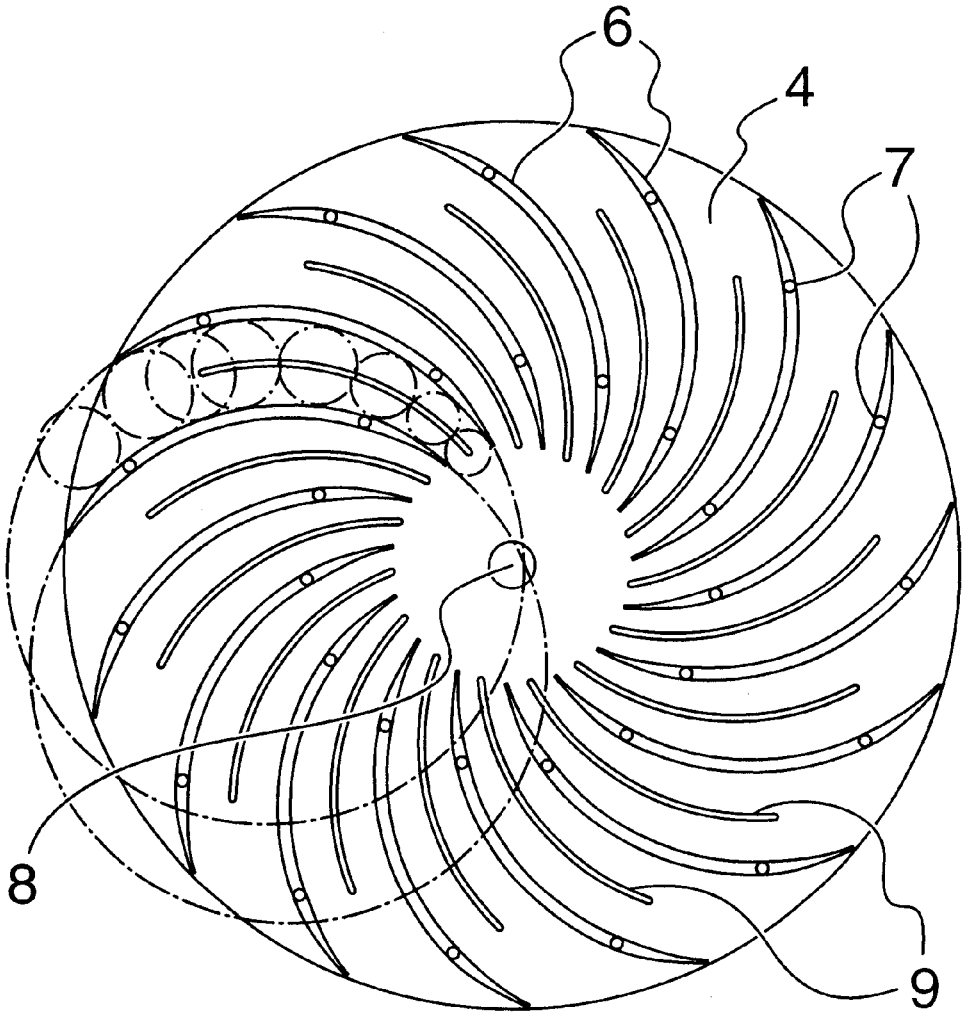
Figure 2C:
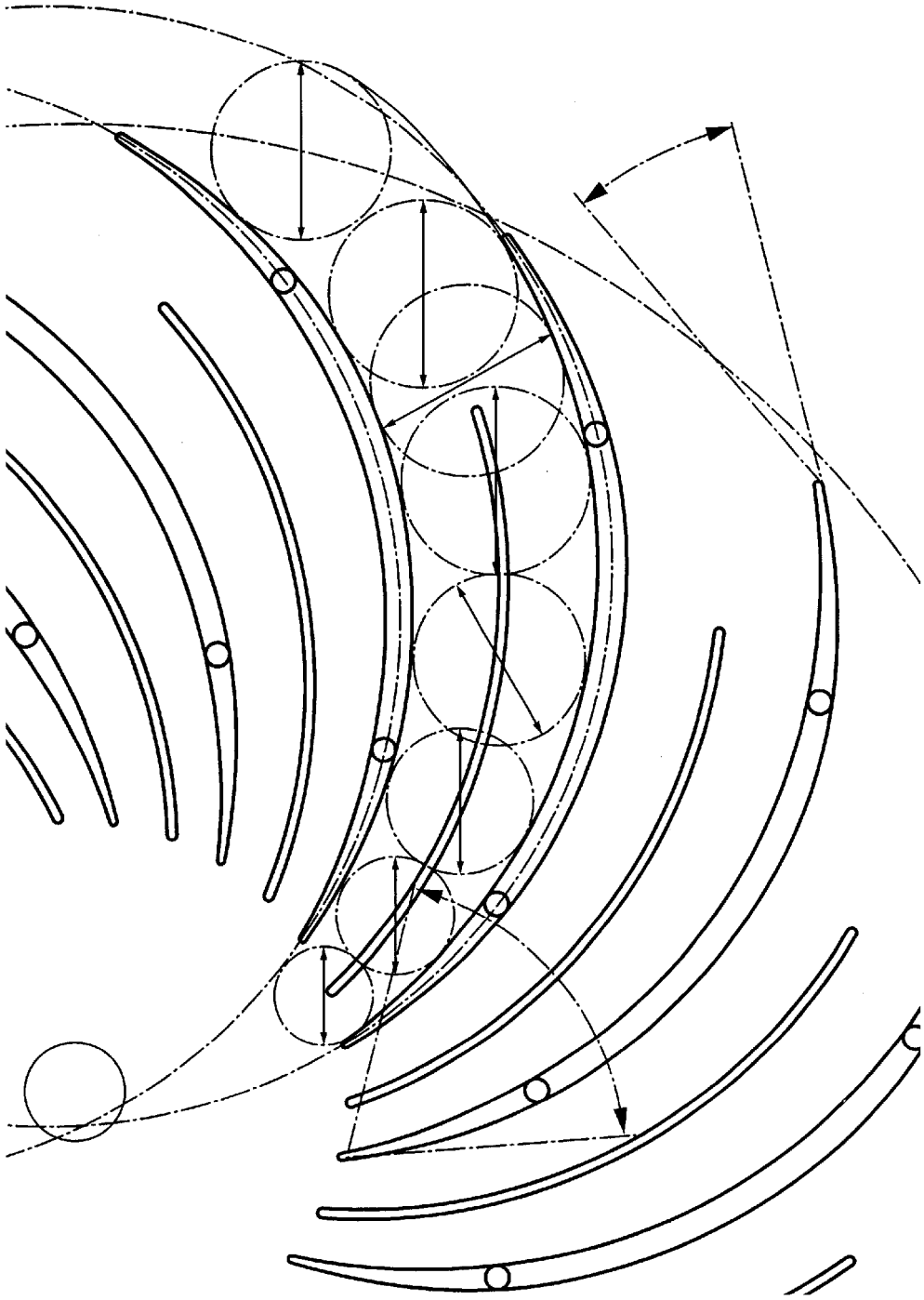

FIGS. 2*a* and 2*c* (detail from FIG. 2 or 2*b*) shows the blade channel, formed by two profiled impeller blades, as well as the blade entry or contact angles and j according to the present invention.

The embodiment of the impeller (4) shown in FIG. 2*b* is milled from one piece (or constructed as a plastic injection moulding), the blade height (5) being constant. The blades (6) are curved rearwards. Cylindrical studs (7) for receiving the cover (1) are located on the blades (6) and arranged on one or more bolthole circles. The studs (7) are ultrasonically welded (in the case of plastic) or riveted (in the case of metal) to the cover (1). The central bore (8) is used for fixing to the driving shaft. The intermediate blades (9) have a constant thickness and terminate at 80% of the impeller diameter.

FIG. 3 shows the complete radial blower.

FIGS. 4, 5, 6, 7 and 8 show the pressure difference as a function of the volume flow, the motor power consumption and the efficiency of the overall system of the radial compressor according to the present invention.

FIG. 9 shows the impeller according to claims 1 and 2 of the present invention, which has a diameter of 26 mm.

FIG. 10 shows the blade channel cross-section $A_k$ as a function of the channel length l according to the present invention.

Other dimensions and weights for the inventive impeller are readily conceivable.

What is claimed is:

1. An impeller for a radial blower, comprising a cover, a central bore for fixing to a driving shaft, a plurality of impeller blades passing in part spiral manner from an outside circumferential edge to the bore defining impeller blade channels between adjacent impeller blades wherein a cross-section $A_k$ of the impeller blade channels increases from a point at the bore to a point two-thirds of the channel length toward the circumferential edge and in the last third of the channel length towards the circumferential edge becomes smaller or remains constant, and wherein the thickness of the impeller blades increases from a point at the bore to a point along the blade and then decreases to a point at the circumferential edge, and the blades having a blade entry angle $\beta_1$ at the bore having a value of >40°.

2. The impeller according to claim 1 wherein the blade channels have an entry angle $\beta_1$ of 55 to 80°.

3. The impeller according to claim 1 further comprising a motor fixed to a driving shaft, which shaft is attached to the bore, which has a total weight, including the motor of <10 g and developes a power consumption of 0.054 Watt.

4. The impeller for a radial blower according to claim 1, wherein each impeller blade channel is divided by a centrally positioned intermediate blade having a constant thickness, which extends 75 to 85% of the distance from the bore to the circumferential edge.

5. A method for using an impeller for a radial blower, comprising providing an impeller comprising a cover, a central bore for fixing to a driving shaft, a plurality of impeller blades passing in part spiral manner from an outside circumferential edge to the bore defining impeller blade channels between adjacent impeller blades, wherein a cross-section $A_k$ of the impeller blade channels increases from a point at the bore to a point two-thirds of the channel length toward the circumferential edge and in the last third of the channel length towards the circumferential edge becomes smaller or remains constant, and wherein the thickness of the impeller blades increases from a point at the bore to a point along the blade and then decreases to a point at the circumferential edge, and the blades having a blade entry angle $\beta_1$ at the bore having a value of >40°; and rotating the impeller about the bore.

* * * * *